US010273106B2

(12) United States Patent
Toussaint et al.

(10) Patent No.: US 10,273,106 B2
(45) Date of Patent: Apr. 30, 2019

(54) MOVABLE ARM

(71) Applicant: HEWLETT-PACKARD DEVELOPMENT COMPANY, L.P., Houston, TX (US)

(72) Inventors: David Toussaint, Barcelona (ES); Lluis Valles Casanova, Badalona (ES); Abel Martinez-Guillen, Hospitalet de Llobregat (ES); Jerry Claesson, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 137 days.

(21) Appl. No.: 15/252,037

(22) Filed: Aug. 30, 2016

(65) Prior Publication Data

US 2018/0057295 A1 Mar. 1, 2018

(51) Int. Cl.

| | |
|---|---|
| ***B65H 23/16*** | (2006.01) |
| ***B65H 26/02*** | (2006.01) |
| ***B65H 23/198*** | (2006.01) |

(52) U.S. Cl.

CPC ..... *B65H 26/025* (2013.01); *B65H 23/16* (2013.01); *B65H 23/198* (2013.01); *B65H 2404/40* (2013.01); *B65H 2404/62* (2013.01); *B65H 2801/36* (2013.01)

(58) Field of Classification Search

CPC ..... B65H 26/025; B65H 23/16; B65H 23/198
See application file for complete search history.

(56) References Cited

U.S. PATENT DOCUMENTS

| | | | | |
|---|---|---|---|---|
| 5,794,869 | A | 8/1998 | Takano et al. | |
| 7,334,787 | B2 | 2/2008 | Akiyama et al. | |
| 8,733,880 | B2 | 5/2014 | Izawa et al. | |
| 8,857,974 | B2 | 10/2014 | Izawa et al. | |
| 8,864,272 | B2 | 10/2014 | Claramunt et al. | |
| 2011/0285801 | A1 | 11/2011 | Okura et al. | |
| 2015/0054895 | A1 | 2/2015 | Suzuki et al. | |
| 2016/0318321 | A1* | 11/2016 | Takahashi | B31D 1/021 |

FOREIGN PATENT DOCUMENTS

| | | | |
|---|---|---|---|
| JP | 2014088264 | A | 5/2014 |
| WO | WO-2014050775 | A1 | 4/2014 |

OTHER PUBLICATIONS

Akiyama, et al.; Advanced Taper Tension Method for the Performance Improvement of a Roll-to-Roll Printing Production Line With a Winding Process; Jun. 2012; http://www.sciencedirect.com/science/article/pii/S0020740312000616.

Epson Stylus Pro 11880; Apr. 28, 2009; http://www.epson.com/prxm/prxm_pdf/11880_brochure.pdf.

* cited by examiner

*Primary Examiner* — Sang K Kim
(74) *Attorney, Agent, or Firm* — Fabian VanCott

(57) ABSTRACT

In one example in accordance with the present disclosure a device to detect media being wound around a wheel is described. The device includes a reel that collects the media and a movable arm pivotally coupled to the reel to provide tension to the media being wound around the reel. The device also includes a controller that detects media is being wound around the reel by 1) determining an angular position of the movable arm and 2) calculating, based on the angular position of the movable arm, when an output of a motor that rotates the reel is non-zero.

17 Claims, 13 Drawing Sheets

MOVABLE ARM

BACKGROUND

Print media, and devices that generate print media, are becoming more and more widespread in society. Some printing devices receive media that is initially formed as a web, or roll. The media is fed through the printing device. After the media has been processed, i.e., after printing fluid has been deposited thereon, the media is wound onto an output reel where the media can be collected for transport or for further processing.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
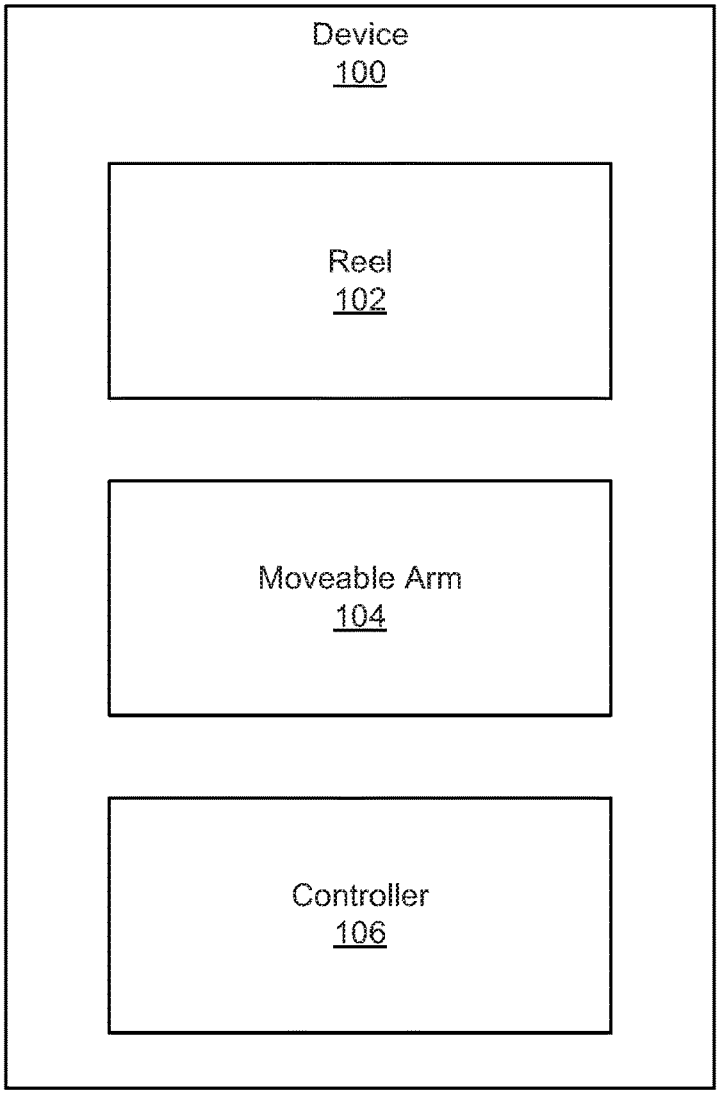
FIG. 1 is a block diagram of a device for detecting media being wound around a reel, according to an example of the principles described herein.

Print media, and devices that generate print media, are becoming more and more widespread in society. Some printing devices receive media that is initially formed as a web, or roll. The media is fed through the printing device and after the media has been processed, i.e., after printing fluid has been deposited thereon, the media is wound onto an output reel where the media can be collected for transport or for further processing.

While it is inarguable that such printing devices have assisted various entities such as individual users and large organizations in producing more, and higher quality products, some properties of the printing devices complicate their use. For example, modern printing devices can do much more than print. They can collate, offset, and even cut the media as it winds through the printing device. Modern printing devices also provide greater control over the printing operation, such as increasing or decreasing the speed at which the print media is passed through the printing device. However, printing device functionality could be improved depending on whether print media is currently being wound onto an output reel. For example, during printing a cutting functionality of the printing device could be temporarily suspended while media is wound onto the output reel. In another example, subsequent accessories/modules that are coupled to the printing device output could operate more efficiently given an identification as to whether media is actively being wound onto the output reel. In yet another example, printing may stop if it is determined that media is not actively being wound around the output reel.

Still further different printing operations may call for different tensions applied to the media and different output modes for the media. For example, depending on the post-printing operations, a user may desire that the printed media be facing out on the output reel. By comparison, and still depending on the post-printing operations, a user may desire that the printed media be facing in on the output reel. These different output formats may be provided by winding the media in opposite directions around the reel.

Still further, different types of media may call for different tensions to be applied during winding. For example, some media such as textiles like wallpaper may be intended to be wound more tightly around the output reel. By comparison, some media that is more prone to deformation due to heat applied during a printing or other operation, may be intended to be wound more loosely around the output reel. A high tension on such deformable material could deform the print media, thus affecting its output quality. Even further, given a system that accommodates winding in both directions, it may be desirable to have the tension be constant, regardless of the winding direction.

Accordingly, the present specification describes devices, methods, and systems that allow for the detection of whether media is being collected on a reel, such as an output reel of a printing device and to adjust the tension of the media being wound around the output reel. Both these operations rely on information collected from sensors that indicate an angular position of the movable arm. In so doing, operation of the printing device can be controlled. That is, certain functionalities of the printing device could be manipulated based on whether or not media is actively winding around the reel. In some examples, this control of the functionalities could include a temporary suspension of some of the components of the printing device. The additional control over printing device functionality increases the capabilities of the printing device to meet customer needs.

Still further, the movable arm, as it can be used to adjust the tension in the media allows for customizable tensions to be incurred based on media winding directions, and characteristics of the winding operation including media type, reel diameter, etc.

Specifically, in one example, a device of the present specification detects media being wound around a reel. In this example, the device includes a reel that collects the media and a movable arm pivotally coupled to the reel. The movable arm provides tension to media as it winds around the reel. The device also includes a controller to detect when media is actively winding around the reel. This is done by determining an angular position of the movable arm and calculating, based on the angular position of the movable arm, when an output of a motor that rotates the reel is non-zero.

A method for detecting when media is being wound around a reel, according to one example includes determining an angular position of a movable arm. Based on the angular position of the movable arm, an output of a motor that rotates the reel is calculated. It is then indicated that media is actively being wound around the reel when the output of the motor that rotates the reel is non-zero.

In one example, a system includes a processor and a machine-readable storage medium communicatively coupled to the processor. The system also includes an instruction set stored in the machine-readable storage medium to cooperate with the processor to detect when media is being wound around a reel. This is done by determining an angular position of the movable arm and calculating, based on the angular position of the movable arm, when an output of a motor that rotates the reel is non-zero. Moreover, the instruction set cooperates with the processor to control operation of a component of a media processing system when media is actively being wound around the reel.

The present specification also describes a device to collect media that includes a reel that collects the media and a movable arm pivotally coupled to the reel to provide tension to the media being wound around the reel. The movable arm changes angular position to provide different tensions to the media. The device also includes a controller to determine the angular position of the movable arm and to adjust the angular position of the movable arm to effectuate a desired tension on the media.

In one example, a media detection device and system 1) enhances printing device performance; 2) tailors printing device functionality based on the presence of media; 3) is cheap and cost-effective to implement; 4) can impart a single tension to media regardless of a wind direction; and 5) can impart different various tensions to the media to accommodate different printing scenarios. However, it is contemplated that the devices disclosed herein may provide useful in addressing other matters and deficiencies in a number of technical areas. Therefore, the systems and methods disclosed herein should not be construed as addressing any of the particular matters.

As used in the present specification and in the appended claims, the term "a number of" or similar language is meant to be understood broadly as any positive number comprising 1 to infinity.

In the following description, for purposes of explanation, numerous specific details are set forth in order to provide a thorough understanding of the present systems and methods. However, in other examples, the present apparatus, systems, and methods may be practiced without these specific details. Reference in the specification to "an example" or similar language means that a particular feature, structure, or characteristic described in connection with that example is included as described, but may not be included in other examples.

Turning now to the figures, FIG. 1 is a block diagram of a device (100) for detecting media being wound around a reel (102), according to one example of the principles described herein. The device (100) may be incorporated into a larger media-processing system. For example, the device (100) may be incorporated into a printing system that deposits printing fluid such as ink onto the media. In another example, the device (100) is incorporated into a laminating system that laminates the media.

The device (100) includes a reel (102) that collects the media. For example, after the media passes through the larger media-processing system and is ready to be removed from the system for further processing or as a finished product, it may be wound onto the reel (102). To ensure that the media wraps cleanly around the reel (102), it may be desirable for the media to be wound with a predetermined tension. If the media is too loose, it could result in wrinkling or a loose wrapping of the media around the reel (102), which could further lead to marring the surface of the media during subsequent operations and/or handling. If the media is too tight, it could tear, causing jamming of the system. The torn media could also necessitate a re-printing of the print media. All of these consequences could lead to inefficient, ineffective use of the printing system and customer dissatisfaction.

Figure 3:
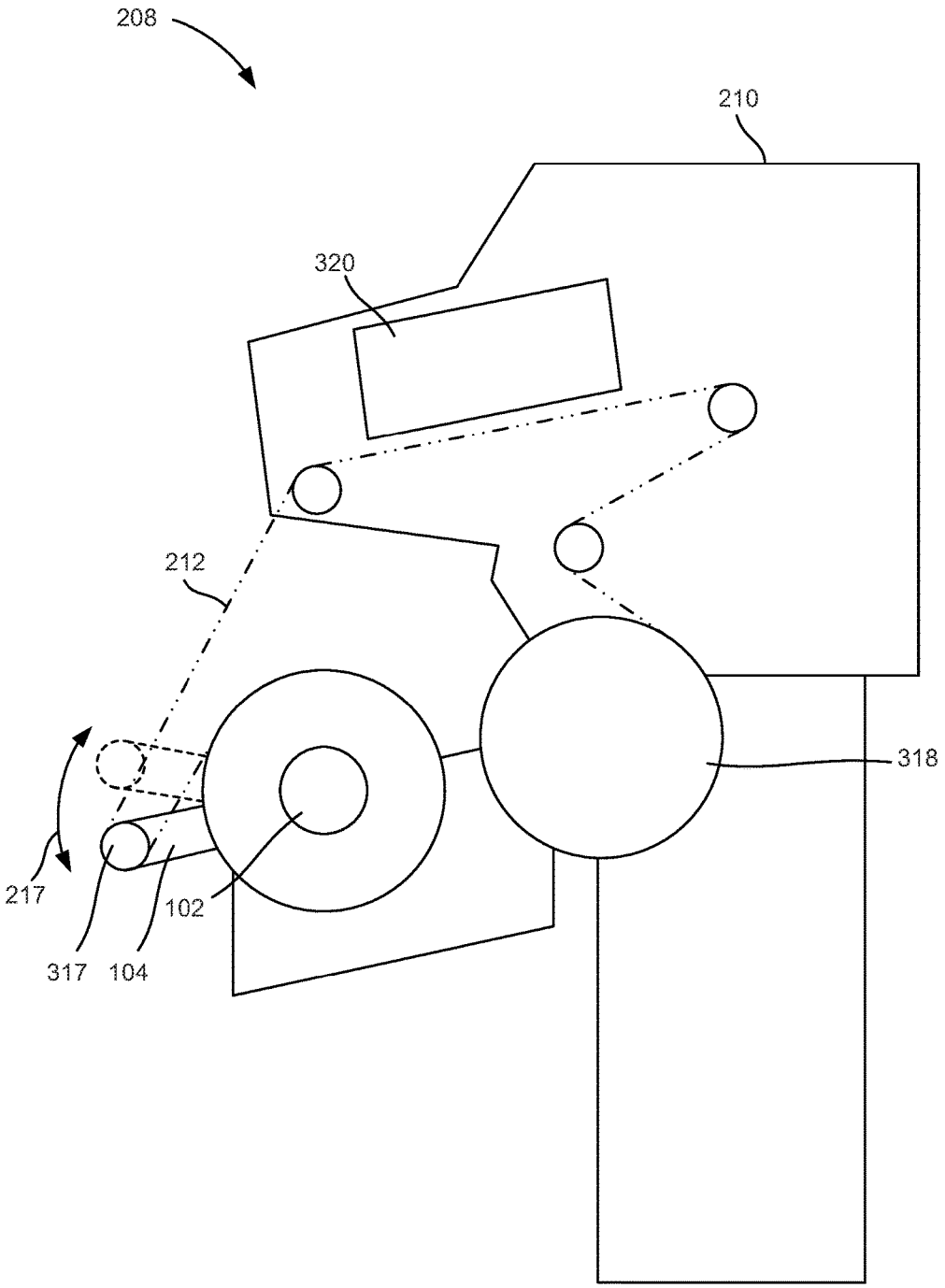
FIG. 3 is a cross-sectional side view of the system on which a device for detecting media being wound around a reel is installed, according to an example of the principles described herein.

Accordingly, the device (100) includes a movable arm (104) pivotally coupled to the reel (102) to provide tension to media as it winds around the reel (102). For example, as depicted in FIG. 3 below, the weight of the movable arm (104) pulls down on media that passes around an underside of the outer diameter of the movable arm (104) shaft. The weight of the movable arm (104) shaft provides tension to media being wound around the reel (102). Depending on the tension on the media, which is estimated based on the position of the movable arm (104), the movable arm (104) position can be adjusted to maintain a predetermined tension. This adjustment of the movable arm (104) position in some examples may be performed by adjusting the power to the reel (102). For example, if the media is too tight, the reel (102) may be slowed down, or in some cases having the rotation reversed, dropping the movable arm (104) and thereby reducing tension. By comparison, if the media is too loose, the reel (102) can increase in speed, raising the movable arm (104) thereby increasing tension on the media.

Accordingly, the movable arm (104) provides at least two functions within the media-processing system. First, the movable arm (104) maintains the output media at a predetermined tension and second, the movable arm (104) facilitates winding the media onto the reel (102) to simplify media handling by a user.

The device (100) also includes a controller (106) to detect when media is being wound around the reel (102). Specifically, the controller (106) uses information about the angular position of the movable arm (104) to calculate the power supplied to the reel (102) to determine whether there is media being wound onto the reel (102). For example, when the movable arm (104) position is in an intermediate position, i.e., not its highest or lowest position, for a certain period of time, then power is being supplied by the motor that moves the reel (102) and it can be determined that media is being wound onto the reel (102). By comparison, when the movable arm (104) is in a highest or lowest position for a certain period of time, then power is not being supplied by the motor that moves the reel (102) and it can be determined that media is not being wound onto the reel (102).

With this information in hand, certain operations of the larger media-processing system, such as a printing system, can be controlled. For example, when media is detected as being wound onto the reel (102), a media cutting component of the printing system could be disabled so as to not prematurely cut media during printing. Another example is the control over the media speed through the printing system could be adjusted. For example, some media performs better with an output tension that is higher. Accordingly, for a given media, the speed of printing can be increased to increase tension.

The greater control over media provided by the operation of the controller (106) thus increases the efficiency, effectiveness, and overall performance of the system in which the device (100) is implemented. Specifically, various operations of a media-processing system can be tailored to different scenarios, i.e., media actively winding around the reel (102) and media not actively being wound around the reel (102). In other words, with the present device (100), media-processing system operation can be differentiated based on whether there is media currently collecting on the reel (102).

Figure 2:
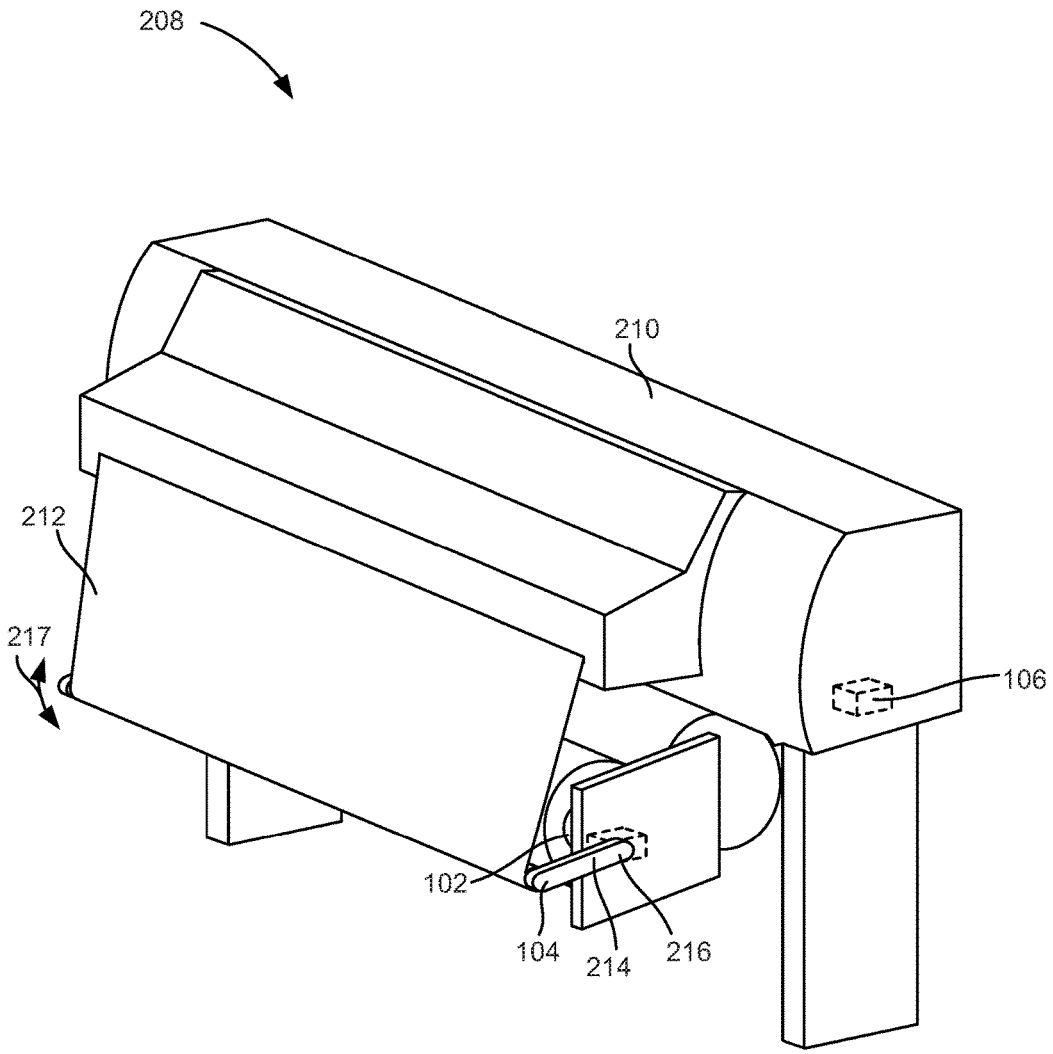
FIG. 2 is an isometric view of a system on which a device for detecting media being wound around a reel is installed, according to an example of the principles described herein.

FIG. 2 is an isometric view of a system (208) on which a device (FIG. 1, 100) for detecting when media (212) is being wound around a reel (102) is installed, according to an example of the principles described herein. The system (208) includes a frame (210) on which components of the device (FIG. 1, 100) are mounted. Specifically, the reel (102) and the movable arm (104) may be coupled to the frame (210). The frame (210) may also house the controller (106) of the device (FIG. 1, 100) that receives information regarding the angular position of the movable arm (104) and that calculates information regarding the output of the motor (214) that rotates the reel (102).

The frame (210) also may house the motor (214) that rotates the reel (102). The motor (214) is represented in dashed lines to indicate it is internal to the frame (210). In some examples, the motor (214) rotates the reel (102) in either a forward or a backward motion. In other words, the motor (214) may cause the media (212) to wind, or unwind from the reel (102). It may be desirable to unwind the media (212) to perform various media handling operations, for example to cut the media (212) at a specific location.

As described above, the device (FIG. 1, 100) includes a reel (102) that receives processed media (212). For example, during operation of the system (208), media (212) may be processed, i.e., printed on or laminated. The media (212) exits the system (208) and is directed around the movable arm (104) and onto the reel (102) as depicted in FIG. 2.

FIG. 2 also depicts the movable arm (104) which pivotally rotates about the reel (102) as indicated by the arrows (217). The movable arm (104) includes various components. Specifically, the media (212) wraps around an elongated shaft of the movable arm (104) and the movable arm (104) is coupled to the frame (210) via a pivot point (216). It is about this pivot point (216) that the shaft rotates.

Via the pivoting motion of the movable arm (104), a desired tension can be applied to the media (212) as it winds around the reel (102). An example of the pivoting of the movable arm (104) and its effect on media (212) tension and its function in determining media (212) presence is provided below in connection with FIG. 3. Also via the position of the movable arm (104), a power supplied by a motor (214) can be deduced, from which a determination regarding media (212) winding around the reel (102) is made.

FIG. 3 is a cross-sectional side view of the system (208) on which a device (FIG. 1, 100) for determining when media (212) is being wound around a reel (102) is installed, according to an example of the principles described herein. For simplicity, the media (212) is indicated in a dash-dot line. Initially the media (212) may be wound around an input reel (318). A motor (FIG. 2, 214) drives the reel (102) which causes the media to proceed through the media-processing system (208). As described above, the media-processing system (208) may perform various operations on the media (212). The media may be of various types as well including paper, vinyl, and latex, among other media (212).

Returning to the media-processing system (208), as the system (208) can perform any number of operations, the device (FIG. 1, 100) that is disposed therein may include a media-processing component (320) for processing the media (212). In one example, the media-processing component (320) is a printing component that deposits printing fluid on the media (212). In another example, the processing component (320) may be a laminating component that applies a protective sheet to both surfaces of the media (212). While FIG. 3 describes a printing component and a laminating component as examples of the media processing component (320) many other types of processes may be carried out on the media (212) via a corresponding media-processing component (320).

Once media has been processed, it is wound onto a reel (102) for further processing, for example by a different system or for distribution or other handling by a user. For various reasons, it may be desirable to wind the media (212) onto the reel (102) at a predetermined tension. To maintain the appropriate tension on the media (212) during collection on the reel (102), the device (FIG. 1, 100) includes a movable arm (104). The movable arm (104) is pivotally coupled to the reel (102) such that an end of the movable arm (104) traces an arc as indicated by the arrow (217). A second position of the movable arm (104) is depicted in ghost in FIG. 3. The weight of the movable arm (104) pulling down against the media (212) as it passes around an outer diameter of a shaft (317) of the movable arm (104) and provides the tension to the media (212) as it is wound onto the reel (102).

A different angular position of the movable arm (104) effectuates a different tension on the media (212). As the movable arm (104) is in constant motion to maintain tension, if the movable arm (104) is stable or stationary for an extended period of time, this can indicate that there is in fact no media (212) actively being wound around the reel (102). Specifically, if the movable arm (104) is in a highest or lowest position for a specified period of time, it could indicate that there is no media (212) actively being wound around the reel (102). Accordingly, the controller (FIG. 1, 106) can collect information regarding the movable arm (104) angular position over time to facilitate a determination as to whether the movable arm (104) is moving, indicating media (212) is being wound, or whether the movable arm (104) is stationary and at a particular angle, facilitating an indication that media (212) is not being wound.

Knowing the angular position of the movable arm (214), an output of the motor (FIG. 2, 214) can be calculated. In other words, there exists a relationship between the angular position of the movable arm (104) and power supplied to the reel (102). Specifically, if the movable arm (104) is at its highest or lowest point, then an output of the motor (FIG. 2, 214) that controls the reel (102) will be zero, indicating no media is being wound around the reel (102). By comparison if the movable arm (104) is in any intermediate position, the motor (FIG. 2, 214) will be supplying some amount of power to the reel (102), indicating that the reel (102) is actively winding media (212). This relationship can be determined experimentally through observation. An example of the highest and lowest positions and determining whether the movable arm (104) is in either of these positions is provided below in connection with FIG. 5.

As described above, from the angular position of the movable arm (104), information regarding the motor (FIG. 2, 214) output that causes the reel (102) to rotate can be determined by the controller (FIG. 1, 106). A motor (FIG. 2, 214) may use a pulse of energy to rotate the reel (102). Different percentages of a full pulse can move the reel (102) to different degrees. For example, a 100% pulse width rotates the reel (102) at a particular speed and a 50% pulse width rotates the reel (102) at another speed. In the present specification, 0% pulse width, or no pulse at all, indicates that media (212) is not being wound around the reel (102). An indication that the motor (FIG. 2, 216) is not outputting any power indicates that the reel (102) isn't moving and that therefore media (212) is not presently being wound around the reel (102).

Figure 4:
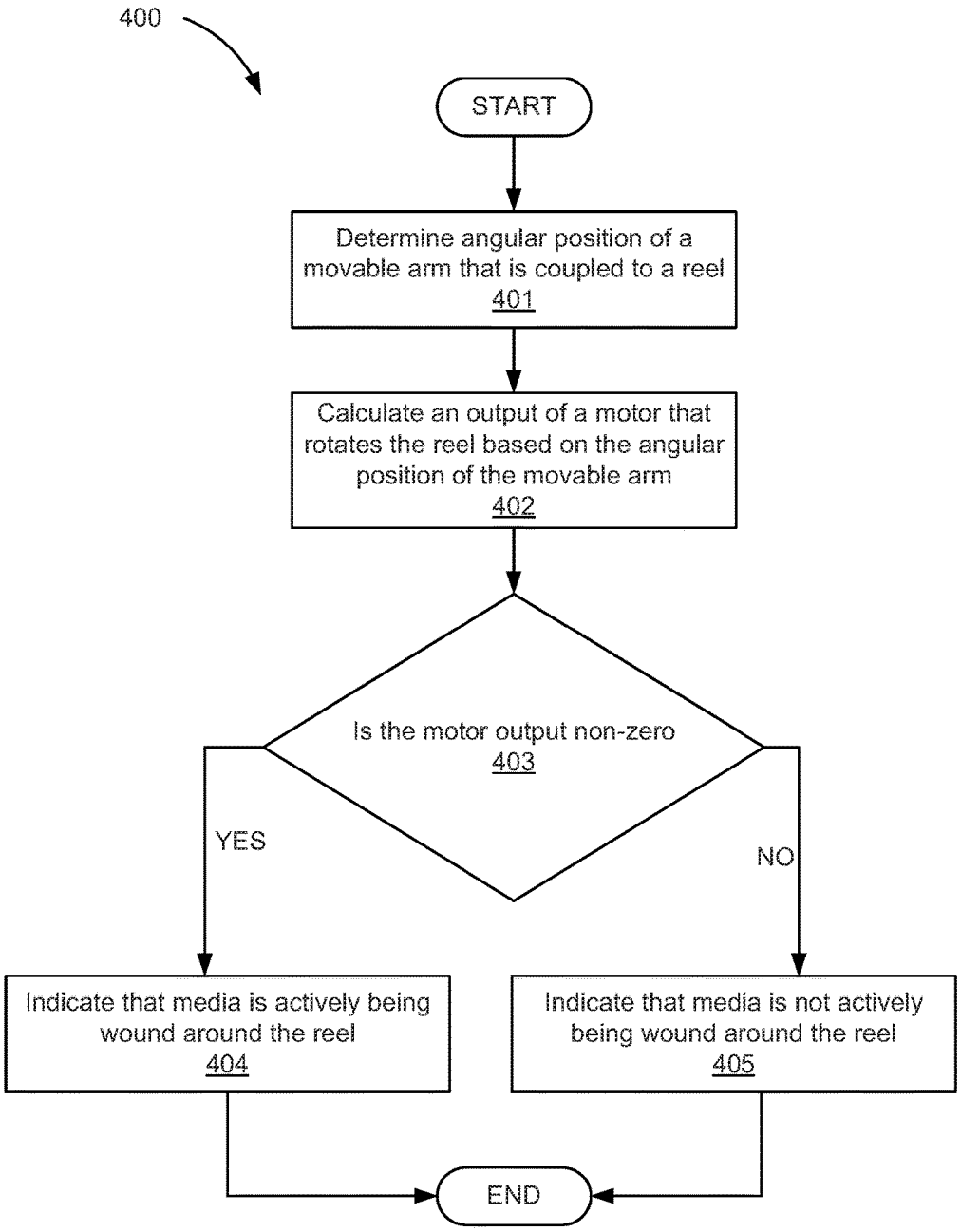
FIG. 4 is a flow diagram of a method for detecting media being wound around a reel, according to an example of the principles described herein.

FIG. 4 is a flow diagram of a method (400) for determining when media (FIG. 2, 212) is being actively wound around a reel (FIG. 1, 102), according to an example of the principles described herein. According to the method (400), a controller (FIG. 1, 106) determines (block 401) an angular position of the movable arm (FIG. 1, 104). For example, the device (FIG. 1, 100) may include a sensor. Data collected from the sensor is passed to the controller (FIG. 1, 106) which can then determine the angular position of the movable arm (FIG. 1, 104). In some examples determining (block 401) an angular position of the movable arm (FIG. 1, 104) includes determining that the angular position has remained the same for some period of time. For example, sensor readings may be taken every few milliseconds. In some examples, a recurring reading over multiple cycles allows the controller (FIG. 1, 106) to determine (block 401) the angular position of the movable arm (FIG. 1, 104).

An example of how the controller (FIG. 1, 106) interacts with a sensor to determine the angular position of a movable arm (FIG. 1, 104) is provided below in connection with FIG. 5. As described above, a movable arm (FIG. 1, 104) that is in its highest or lowest position facilitates a determination that no media (FIG. 2, 212) is being actively wound around the reel (FIG. 1, 102).

From the angular position information of the movable arm (FIG. 1, 104), the controller (FIG. 1, 106) can calculate (block 402) an output of a motor (FIG. 2, 214) that rotates the reel (FIG. 1, 102). For example, when the movable arm is in its highest or lowest angular position, it can be determined that an output of the motor (FIG. 2, 214) is zero which indicates no media (FIG. 2, 212) is being actively wound around the reel (FIG. 1, 102). By comparison, if the movable arm (FIG. 1, 104) is in any intermediate position it is indicative that the motor (FIG. 2, 214) output is non-zero, meaning it is actively winding media (FIG. 2, 212).

If the controller (FIG. 1, 106) determines that the motor (FIG. 2, 214) output is non-zero (block 403, determination YES), the controller (FIG. 1, 106) may indicate (block 404) that media (FIG. 2, 212) is actively being wound around the reel (FIG. 1, 102). In this example, the controller (FIG. 1, 106) may pass such an indication on to the larger media-processing system (FIG. 2, 208) in which the device (FIG. 1, 100) is incorporated so as to adjust operation of the media-processing system (FIG. 2, 208) accordingly. For example, a media-cutting device of the media-processing system (FIG. 2, 208) may be temporarily suspended in order to not cut media (FIG. 2, 212) that is currently being processed.

By comparison, if the controller (FIG. 1, 106) determines that the motor (FIG. 2, 214) output is zero (block 403, determination NO), the controller (FIG. 1, 106) may indicate (block 405) that media (FIG. 2, 212) is not actively being wound around the reel (FIG. 1, 102). In this example, the controller (FIG. 1, 106) may pass such an indication on to the larger media-processing system (FIG. 2, 208) in which the device (FIG. 1, 100) is incorporated so as to adjust operation of the media-processing system (FIG. 2, 208) accordingly. For example, a media-cutting device of the media-processing system (FIG. 2, 208) may be permitted to operate to cut the media (FIG. 2, 212).

Using the above presented method (400), an accurate determination of whether media (FIG. 2, 212) is actively being wound around a reel (FIG. 1, 102) can be made, which determination will allow a parent media-processing system (FIG. 2, 208) to more efficiently operate by adjusting operating parameters of various components based on the presence of media (FIG. 2, 212) in the media-processing system (FIG. 2, 208).

Figure 5:
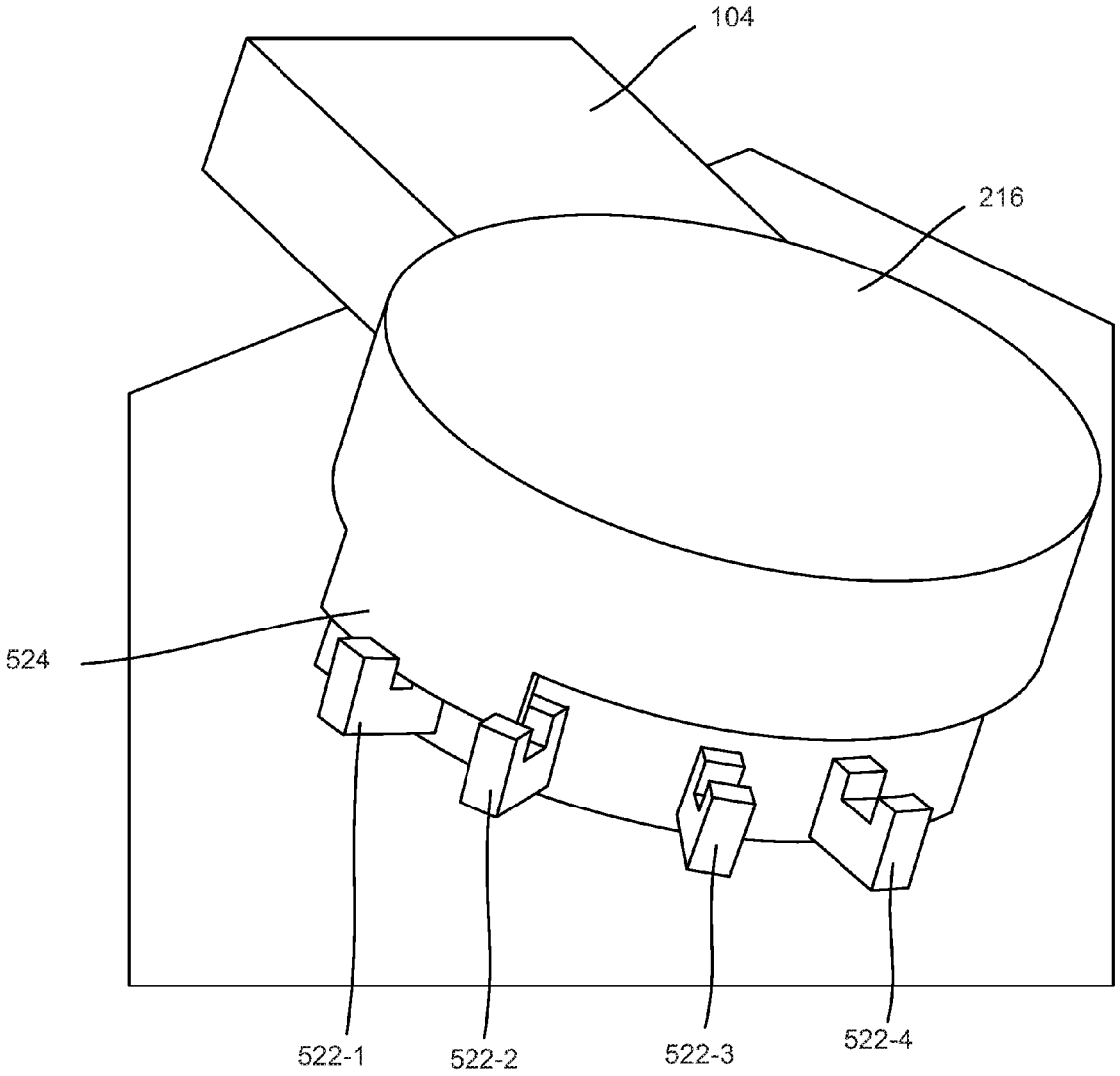
FIG. 5 is an isometric view of an optical sensor for determining the angular position of the movable arm, according to an example of the principles described herein.

FIG. 5 is an isometric view of a sensor for determining the angular position of the movable arm (104), according to an example of the principles described herein. As described above, the device (FIG. 1, 100) includes a controller (FIG. 1, 106) that relies on a determination of the angular position of a movable arm (104) relative to the reel (FIG. 1, 102). Accordingly, in some examples, the device (FIG. 1, 100) includes a sensor to provide the controller (FIG. 1, 106) with information regarding the angular position of the movable arm (104).

For example, as depicted in FIG. 5, the sensor may include a series of radially positioned optical sensors (522). Note that while FIG. 5 depicts four radially-positioned optical sensors (522-1, 522-2, 522-3, 522-4) any number of radially-positioned optical sensors (522) may be used with a greater number of optical sensors (522) providing a more accurate determination of movable arm (104) position. In this example, each optical sensor (522) includes an emitter and a detector that are separated by a gap. The emitter emits a beam of light or other energy beam that is gathered or detected by a corresponding detector. The pivot point (216) of the movable arm (104) may include a flange (524) that rotates as the movable arm (104) pivots. The flange (524) of the movable arm (104) is aligned with the gap between the emitter and detector of the optical sensors (522). As the movable arm (104) rotates, the flange (524) passes through the gap thereby interrupting the light path between an emitter and a detector. Such an interruption is detected and thereby indicates the position of the flange (524) and the corresponding position of the movable arm (104).

The controller (FIG. 1, 106) receives signals from the different optical sensors (522) and by determining which signal indicates an obstruction between the emitter and detector, the controller (FIG. 1, 106) can identify the position of the movable arm (104).

Moreover, as described above there is a relationship between motor (FIG. 2, 214) output and movable arm (104) angular position. Such a relationship can be determined mathematically or though experimentation. For example, if all the sensors (522) are uninterrupted, then this means that the movable arm (104) is in its highest position or its lowest position, and would indicate a motor (FIG. 2, 214) output of zero. By comparison, if the first two sensors (522-1, 522-2) are interrupted, then a motor (FIG. 2, 214) output could be calculated to be a first value. If the second and third sensors (522-2, 522-3) are interrupted then the motor (FIG. 2, 214) output could be calculated to be a second value. Still further, if the third and fourth sensors (522-3, 522-4) are interrupted, then the motor (FIG. 2, 214) output could be calculated to be a third value. Accordingly, based on sensor (522) measurements and a known relationship between angular position and motor (FIG. 2, 214) output, an output of the motor (FIG. 2, 214) that rotates the reel (FIG. 1, 102) can be determined, and accordingly, a determination made as to whether media (FIG. 2, 212) is actively winding around the reel (FIG. 1, 102).

While FIG. 5 depicts a specific type of sensor, other types of sensors may also be used. For example, an outside diameter of the pivot point 9216) may include alternating lines (for example of black and white), that may have decreasing widths. An optical sensor can read the width of the alternating lines to determine the position of the movable arm (104).

Figure 6:
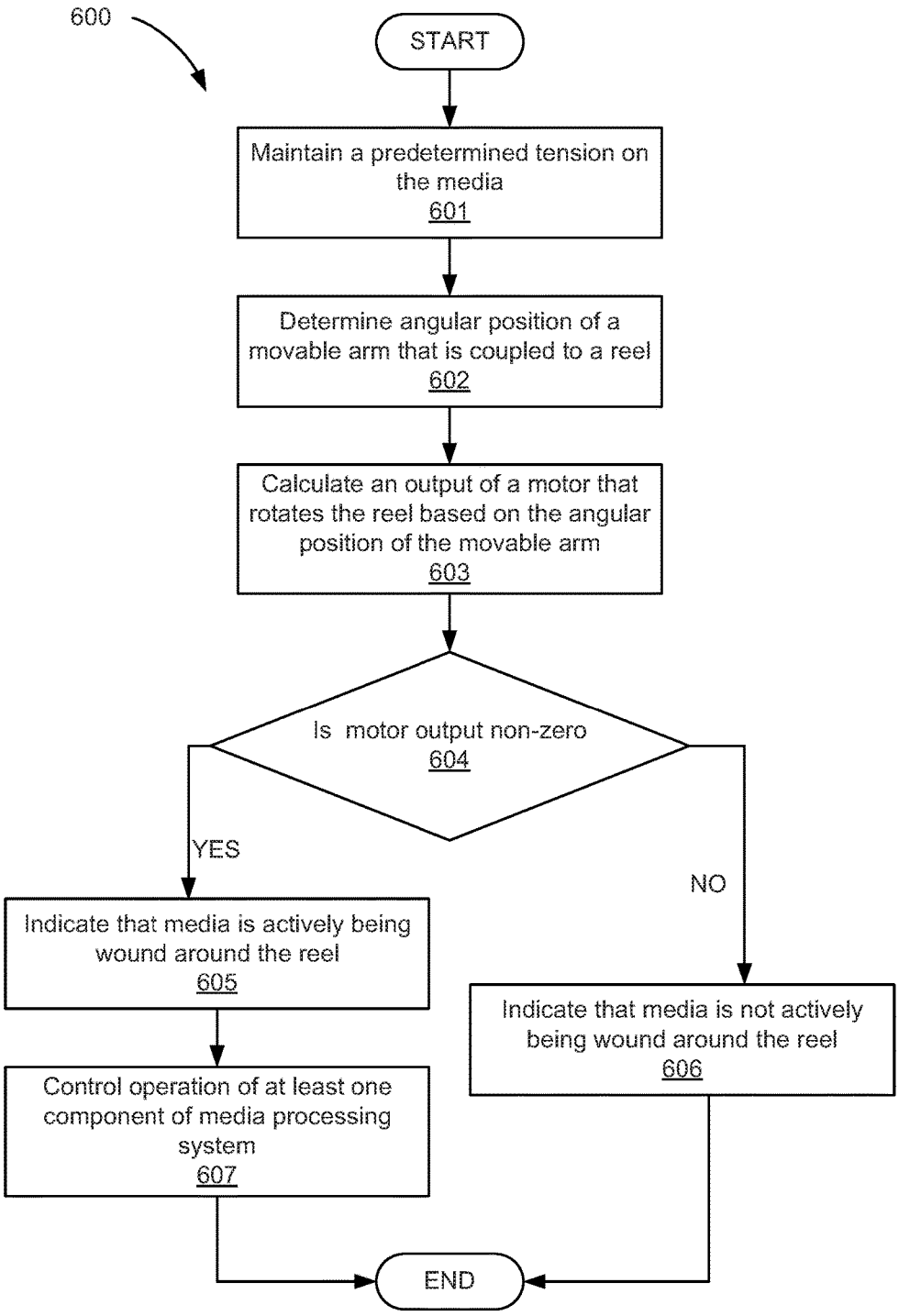
FIG. 6 is a flow diagram of a method for detecting media being wound around a reel, according to another example of the principles described herein.

FIG. 6 is a flow diagram of a method (600) for detecting when media (FIG. 2, 212) is being wound around a reel (FIG. 1, 102), according to another example of the principles described herein. According to the method (600), media (FIG. 2, 212) is maintained (block 601) at a predetermined tension. For example, during winding, the tension on media (FIG. 2, 212) may change for various reasons including amount of paper on input roll, amount of paper on reel (FIG. 1, 102). The tension can be kept at a predetermined level via the movement of the movable arm (FIG. 1, 104). The movable arm (FIG. 1, 104) provides tension as the weight of the movable arm (FIG. 1, 104) rests on the media (FIG. 2, 212) that passes around and under an outside diameter of a shaft (FIG. 3, 317) of the movable arm (FIG. 1, 104). The weight of the movable arm (FIG. 1, 104) provides a constant tension for the media (FIG. 2, 212) as it passes through the system.

A determination is then made (block 602) as to the angular position of the movable arm (FIG. 2, 214) that is coupled to the reel (FIG. 1, 102). This may be performed as described above in connection with FIG. 4. From the angular position of the movable arm (FIG. 1, 104), an output of a motor (FIG. 2, 214) that rotates the reel (FIG. 1, 102) is calculated (block 603). This can be performed as described above in connection with FIG. 4. If the controller (FIG. 1, 106) determines that the motor (FIG. 2, 214) output is zero (block 604, determination NO), then the controller (FIG. 1, 106) indicates (block 606) that media (FIG. 2, 212) is not actively being wound around the reel (FIG. 1, 102). This can be performed as described above in connection with FIG. 4.

If the controller (FIG. 1, 106) determines that the motor (FIG. 2, 214) output is non-zero (block 604, determination YES), then the controller (FIG. 1, 106) indicates (block 605) that media (FIG. 2, 212) is actively being wound around the reel (FIG. 1, 102). This can be performed as described above in connection with FIG. 4.

If media (FIG. 2, 212) is actively being wound, the controller (FIG. 1, 106) can then control (block 607) operation of at least one component of the media-processing system (FIG. 2, 208). Examples of components that may be controlled by the controller (FIG. 1, 106) dependent upon media (FIG. 2, 212) presence include a media cutting system and a media transporting system. For example, the controller (FIG. 1, 106) may temporarily suspend the operation of a component such as a media cutting system, such that the media cutting system does not cut media (FIG. 2, 212) while media (FIG. 2, 212) is being wound. By comparison, if media (FIG. 2, 212) is done being processed and is stationary on the reel (FIG. 1, 102), i.e. the movable arm (FIG. 1, 104) is stationary in a highest or lowest position and the motor (FIG. 2, 214) output is zero, it may indicate that media (FIG. 2, 212) is not actively winding around the reel (FIG. 1,102). In this example, the controller (FIG. 1, 106) may allow the media-cutting device to operate as normal. In another example, the media transport system may be altered. For example, if media (FIG. 2, 212) is being wound on to the output reel (FIG. 1, 102), the controller (FIG. 1, 106) may instruct a motor to increase or decrease the speed of transport of the media.

To facilitate this control, the controller (FIG. 1, 106) may send a control signal to the media-processing system (FIG. 2, 208). For example, the controller (FIG. 1, 106) could pass a control signal to a component of the printing system that manages the cutting device. In this example, the device (FIG. 1, 100) may be external to the controller of the printing system, which controls the components of the printing system. Thus, according to the method (600) described herein, media (FIG. 2, 212) presence can be easily detected relying on data from the same device that provides tension to the system. In so doing greater control over media-processing system (FIG. 2, 208) functionality is provided as the system operation is differentiated between when media (FIG. 2, 212) is present and when media (FIG. 2, 212) is not present.

Figure 7:
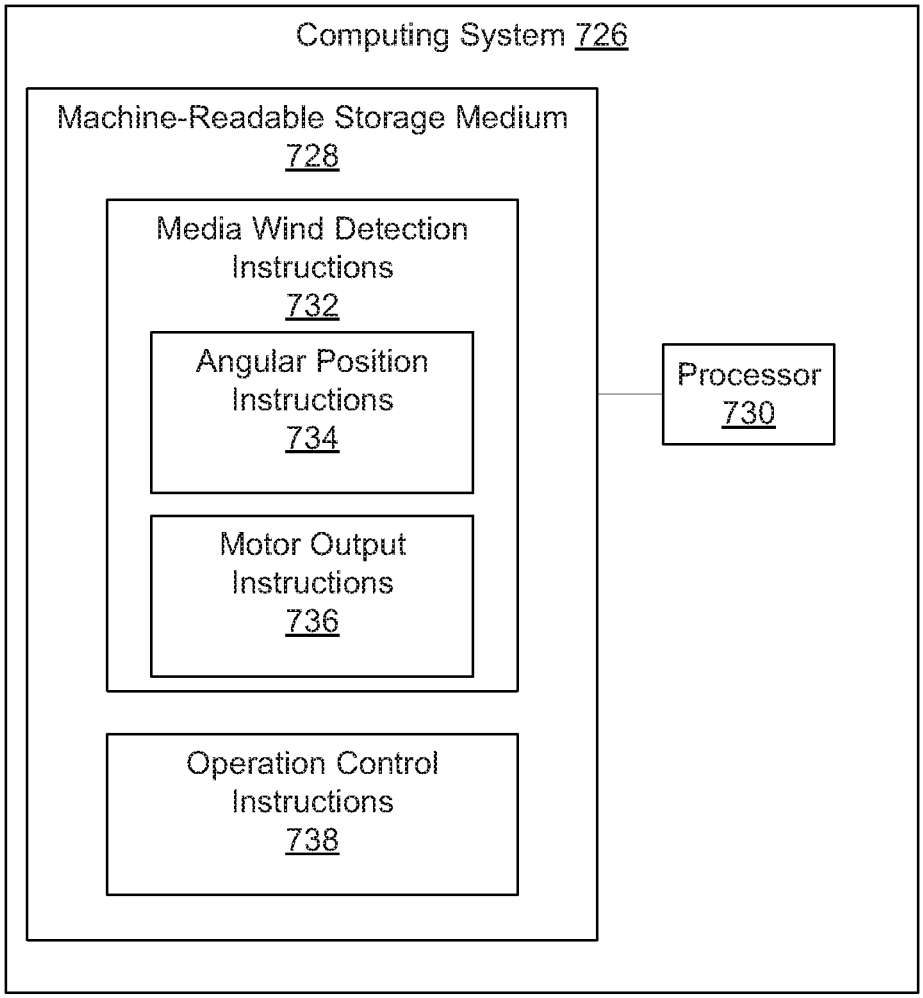
FIG. 7 is a block diagram of a system for detecting media being wound around a reel, according to an example of the principles described herein.

FIG. 7 is a block diagram of a computing system (726) for detecting whether media is actively winding around a reel (FIG. 1, 102), according to an example of the principles described herein. To achieve its desired functionality, the computing system (726) includes various hardware components. Specifically, the computing system (726) includes a processor (730) and a machine-readable storage medium (728). The machine-readable storage medium (728) is communicatively coupled to the processor (730). The machine-readable storage medium (728) includes a number of instruction sets (732, 734, 736, 738) for performing a designated function. The machine-readable storage medium (728) causes the processor (730) to execute the designated function of the instruction sets (732, 734, 736, 738).

Although the following descriptions refer to a single processor (730) and a single machine-readable storage medium (728), the descriptions may also apply to a computing system (726) with multiple processors and multiple machine-readable storage mediums. In such examples, the instruction sets (732, 734, 736, 738) may be distributed (e.g., stored) across multiple machine-readable storage mediums and the instructions may be distributed (e.g., executed by) across multiple processors.

The processor (730) may include at least one processor and other resources used to process programmed instructions. For example, the processor (730) may be a number of central processing units (CPUs), microprocessors, and/or other hardware devices suitable for retrieval and execution of instructions stored in machine-readable storage medium (728). In the computing system (726) depicted in FIG. 7, the processor (730) may fetch, decode, and execute instructions (732, 734, 736, 738) for detecting media presence. In one example, the processor (730) may include a number of electronic circuits comprising a number of electronic components for performing the functionality of a number of the instructions in the machine-readable storage medium (728). With respect to the executable instruction representations (e.g., boxes) described and shown herein, it should be understood that part or all of the executable instructions and/or electronic circuits included within one box may, in alternate examples, be included in a different box shown in the figures or in a different box not shown.

The machine-readable storage medium (728) represent generally any memory capable of storing data such as programmed instructions or data structures used by the computing system (726). The machine-readable storage medium (728) includes a machine-readable storage medium that contains machine-readable program code to cause tasks to be executed by the processor (730). The machine-readable storage medium (728) may be tangible and/or non-transitory storage medium. The machine-readable storage medium (728) may be any appropriate storage medium that is not a transmission storage medium. For example, the machine-readable storage medium (728) may be any electronic, magnetic, optical, or other physical storage device that stores executable instructions. Thus, machine-readable storage medium (728) may be, for example, Random Access Memory (RAM), a storage drive, an optical disc, and the like. The machine-readable storage medium (728) may be disposed within the computing system (726), as shown in FIG. 7. In this situation, the executable instructions may be "installed" on the computing system (726). In one example, the machine-readable storage medium (728) may be a portable, external or remote storage medium, for example, that allows the computing system (726) to download the instructions from the portable/external/remote storage medium. In this situation, the executable instructions may be part of an "installation package". As described herein, the machine-readable storage medium (728) may be encoded with executable instructions for dual-power reception.

Referring to FIG. 7, media wind detection instructions (732), when executed by a processor (730), may cause the computing system (726) to detect when media is being wound around a reel (FIG. 1, 102). Specifically, angular position instructions (734), when executed by a processor (730), may cause the computing system (726) to determine an angular position of the movable arm (FIG. 1, 104) that is coupled to the reel (FIG. 1, 102). Motor output instructions (736), when executed by a processor (730), may cause the computing system (726) to calculate, based on the angular position of the movable arm (FIG. 1, 102), when a motor (FIG. 2, 214) that provides power to the reel (FIG. 1, 102) is non-zero. Operation control instructions (738), when executed by a processor (730), may cause the computing system (726) to control operation over at least one component of a media-processing system (FIG. 2, 208).

In some examples, the processor (730) and machine-readable storage medium (728) are located within the same physical component, such as a server, or a network component. The machine-readable storage medium (728) may be part of the physical component's main memory, caches, registers, non-volatile memory, or elsewhere in the physical component's memory hierarchy. In one example, the machine-readable storage medium (728) may be in communication with the processor (730) over a network. Thus, the computing system (726) may be implemented on a user device, on a server, on a collection of servers, or combinations thereof.

The computing system (726) of FIG. 7 may be part of a general-purpose computer. However, in some examples, the computing system (726) is part of an application specific integrated circuit.

Figure 8:
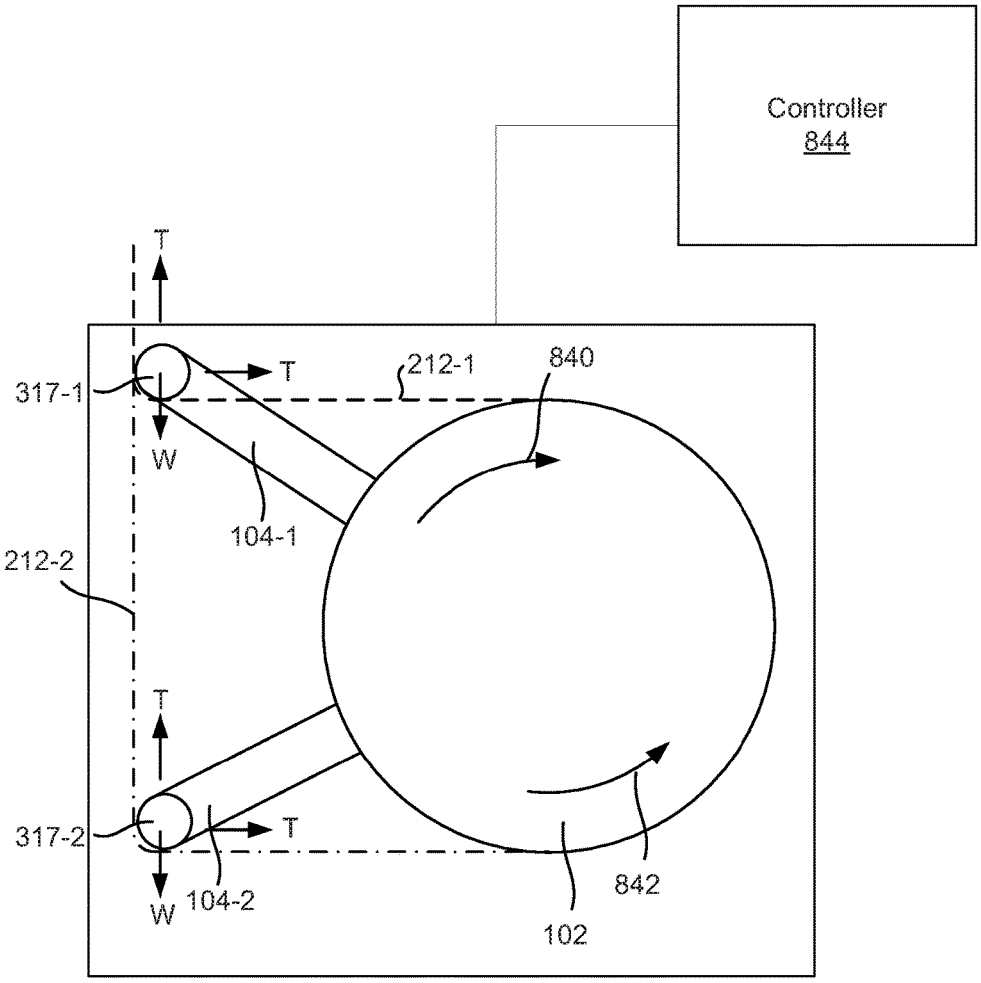
FIG. 8 is a cross-sectional side view of a device for adjusting tension on media being wound around a reel, according to an example of the principles described herein.

FIG. 8 is a cross-sectional side view of a device for adjusting tension on media being wound around a reel (102), according to an example of the principles described herein. As described above, the device includes a reel (102) that collects the media. Specifically, the reel (102) can collect media in at least two different orientations. In a first winding direction, such as a clockwise direction (840), media has one orientation, for example, the printed surface may face inward. A media path (212-1) corresponding to the first orientation is indicated by a dashed line.

The reel (102) can also collect media in a second orientation by winding the media in a second winding direction, such as a counterclockwise direction (842). In this orientation, the printed surface of the media may face outward. The media path (212-2) corresponding to the second orientation is indicated by the dashed-dot line. As will be described below, depending upon the winding direction, the movable arm (104) is placed in one of at least two positions to provide the same tension on the media, regardless of the winding direction. The first position of the movable arm may be referred to as an up-position and may be used when the media is wound in a clockwise direction (840). The second position of the movable arm may be referred to as a down-position and may be used when the media is wound in a counter-clockwise direction (842).

The movable arm (FIG. 1, 104) is pivotally coupled to the reel (102) and provides tension to the media. Specifically, as the media passes around a portion of an outside diameter of the shaft (317), the weight, W, of the movable arm (104) pulls against the media, thereby providing tension to the media. Depending on the winding direction of the media around the reel (102), the angular position of the movable arm (104) can be changed. For example, when winding in the clockwise direction (840), the movable arm (104) and the shaft (317) of the movable arm may be in a first position, or up-position, indicated by the reference numbers (317-1) and (104-1). By comparison, when winding in the counterclockwise direction (842), the movable arm (104) and the shaft (317) and may be in a second position, or down-position, indicated by the reference numbers (317-2) and (104-2). In other words, a change in the suffix of a reference number indicates the component, i.e., the shaft (317) or movable arm (104) in a different position.

By changing between these two positions depending upon the winding direction, the movable arm (104) can provide the same tension to the media regardless of the winding direction. Put another way, when winding in the clockwise direction (840), the movable arm (104) being in the first position winds the media with a first tension, and when winding in the counterclockwise direction (842), the movable arm (104) being in the second position winds the media with a second tension, the first tension and the second tension having the same value. For example, when in the first position indicated by the reference suffix, −1, the tension on the media can be defined as T=W. Similarly, when in the second position indicated by the reference suffix, −2, the tension on the media can be defined as T=W. With the same amount of tension provided in either case, a user can rest assured that regardless of the winding direction, the media is being wound with a certain degree of tension.

By allowing for media winding in either of two orientations, the printing system in which the device is installed has greater applicability as it provides the user with more options regarding the output settings of the media on the reel (102).

The device also includes a controller (844) that is used to adjust the angular position of the movable arm (104). Specifically, the controller (844) determines the angular position of the movable arm (104) and can then adjust an angular position of the movable arm (104) to effectuate a desired tension on the media. For example, it may be desirable for different substrates to be wound with different tensions. Specifically, certain textile substrates such as wallpaper may be wound at a higher tension, while substrates that are more prone to heat-deformation may be wound at a lower tension. Accordingly, the controller (844) may receive input from a user indicating a particular type of media is being acted upon, and the controller (844) may then adjust the tension accordingly. The controller (844) may adjust the angular position, and the tension, based on other criteria as well. For example, as the diameter of the reel (102) expands as media is wound onto it, the tension may change. Accordingly, the controller (844) may adjust the tension so as to maintain constant tension despite changes in the diameter of the reel (102).

Adjustment of the angular position of the movable arm (104) may be carried out by adjusting the winding speed of the reel (102). For example, a faster wind speed may move the movable arm (104) to a position where greater tension is imparted, and slowing down the winding may move the movable arm (104) to a position where less tension is imparted.

Determining the angular position of the movable arm (104) may be carried out via the sensor described above. Accordingly, during an operation, the controller (844) may receive input such as a media type or a media roll diameter. The controller (844) then collects information from the sensors indicative of a current angular position of the movable arm (104). If the input dictates a change in the angular position of the movable arm (104) relative to the current position as indicated by the sensors, the controller (844) may send a signal to a motor (FIG. 2, 216) that controls the reel (102) to increase the degree of rotation of the reel (102). The increase in speed of the reel (102) changes the position of the movable arm (104) thereby effectuating the desired tension on the winding media.

The system described in FIG. 8 can thereby accommodate media winding in various orientations, specifically a "printed surface out" orientation and a "printed surface in" orientation. In either orientation, the tension can be maintained at a consistent predetermined level due to the change in angular position of the movable arm (104). Again, due to the changeable position of the movable arm (104), different media types that benefit from differing tensions can be operated upon by the same system in which the movable arm (104) is installed.

Figure 9:
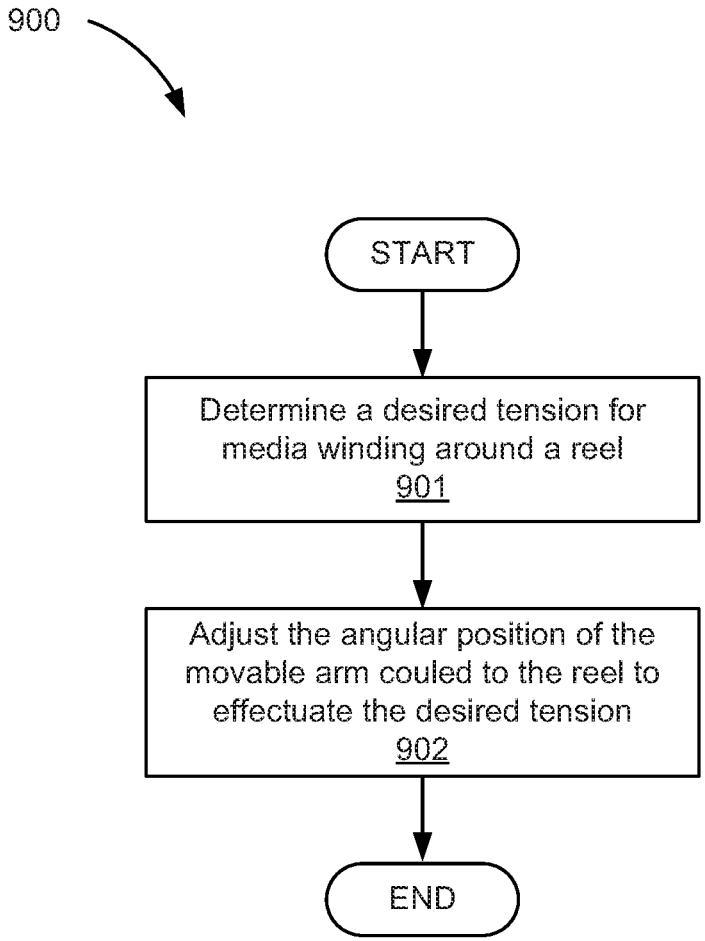
FIG. 9 is a flow diagram of a method for adjusting tension on media being wound around a reel, according to an example of the principles described herein.

FIG. 9 is a flow diagram of a method (900) for adjusting tension on media being wound around a reel (FIG. 1, 102), according to an example of the principles described herein. First, according to the method (900), a desired tension for the media being wound around the reel (FIG. 1, 102) is determined. There are various ways this may occur. For example, the controller (FIG. 844) may receive user input regarding the desired tension. The user input may be a type of media, and the controller (FIG. 8, 844) may determine an appropriate tension based on the input type of media. In another example, the determination (block 901) may be based on properties of the system, such as a diameter of the media roll that is wound around the reel (FIG. 1, 102).

Next, the angular position of the movable arm (FIG. 1, 104) that is coupled to the reel (FIG. 1, 102) is adjusted (block 902) so as to effectuate the desired tension. For example, via the sensors, the controller (FIG. 8, 844) may determine a current position of the movable arm (FIG. 1, 104) and then via the speed of the output reel (FIG. 1, 102) may increase or decrease the height of the movable arm (FIG. 1, 102) so as to effectuate the desired tension.

Figure 10:
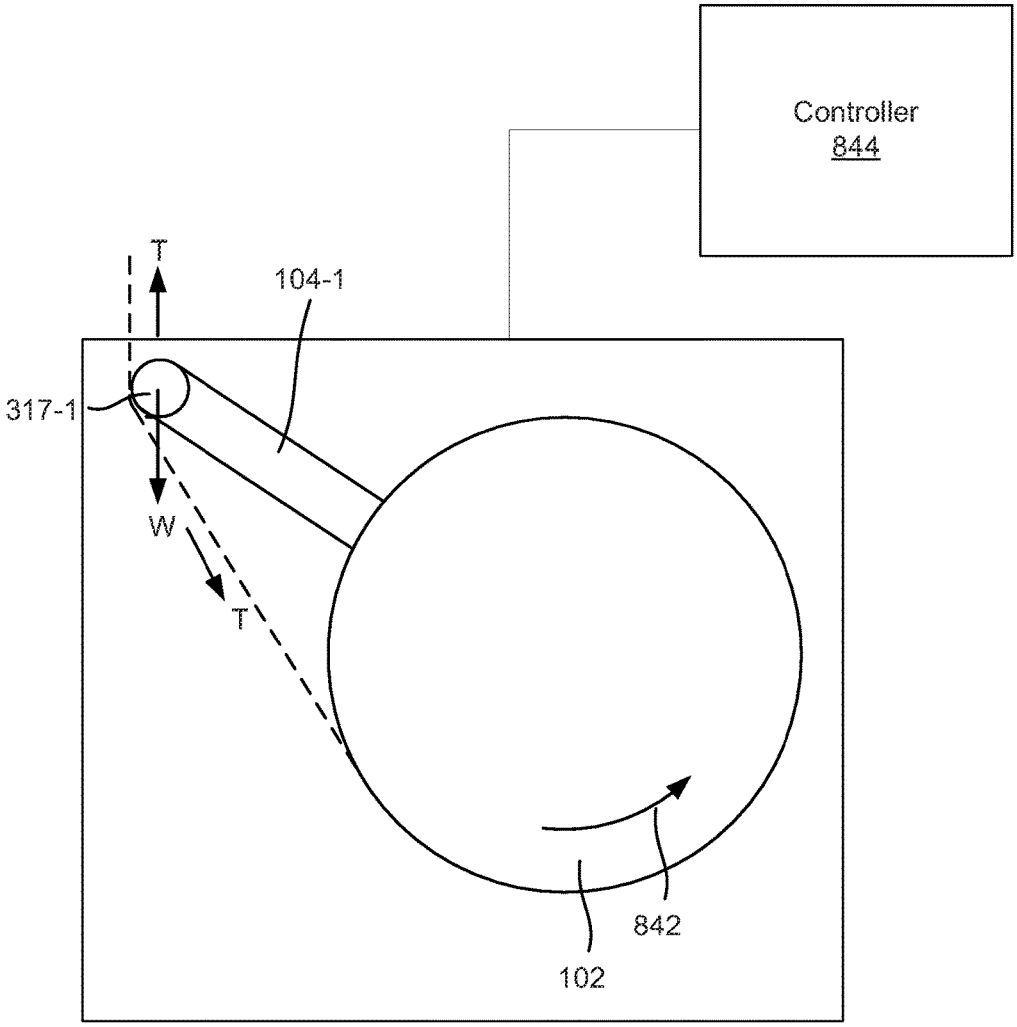
FIG. 10 is a cross-sectional side view of the movable arm in a higher tension setting, according to an example of the principles described herein.

FIG. 10 is a cross-sectional side view of the movable arm (104) in a higher tension setting, according to an example of the principles described herein. In addition to maintaining either a first tension or a second tension on the media winding around the reel (102), the movable arm (104) can allow for winding the media with a third tension, which is greater than both the first tension and the second tension, or winding the media with a fourth tension, which is less than the first tension and the second tension. FIG. 10 depicts a winding with a third tension, which is greater than both of the first tension and the second tension. This may be done by altering the position of the movable arm (104) relative to the winding direction. For example, to impart a second tension, the media is wound in the counterclockwise direction (842), and the movable arm (104) is in a lowered position as indicated by the reference number (FIG. 8, 104-2) as depicted in FIG. 8. To effectuate the third tension, the movable arm (104) and shaft (317) may be raised to the upper position as indicated by the reference numbers (104-1) and (317-1) while continuing to wind the media in the counterclockwise direction (842). Doing so increases the tension on the media on account of the angle of the movable arm (104).

Figure 11:
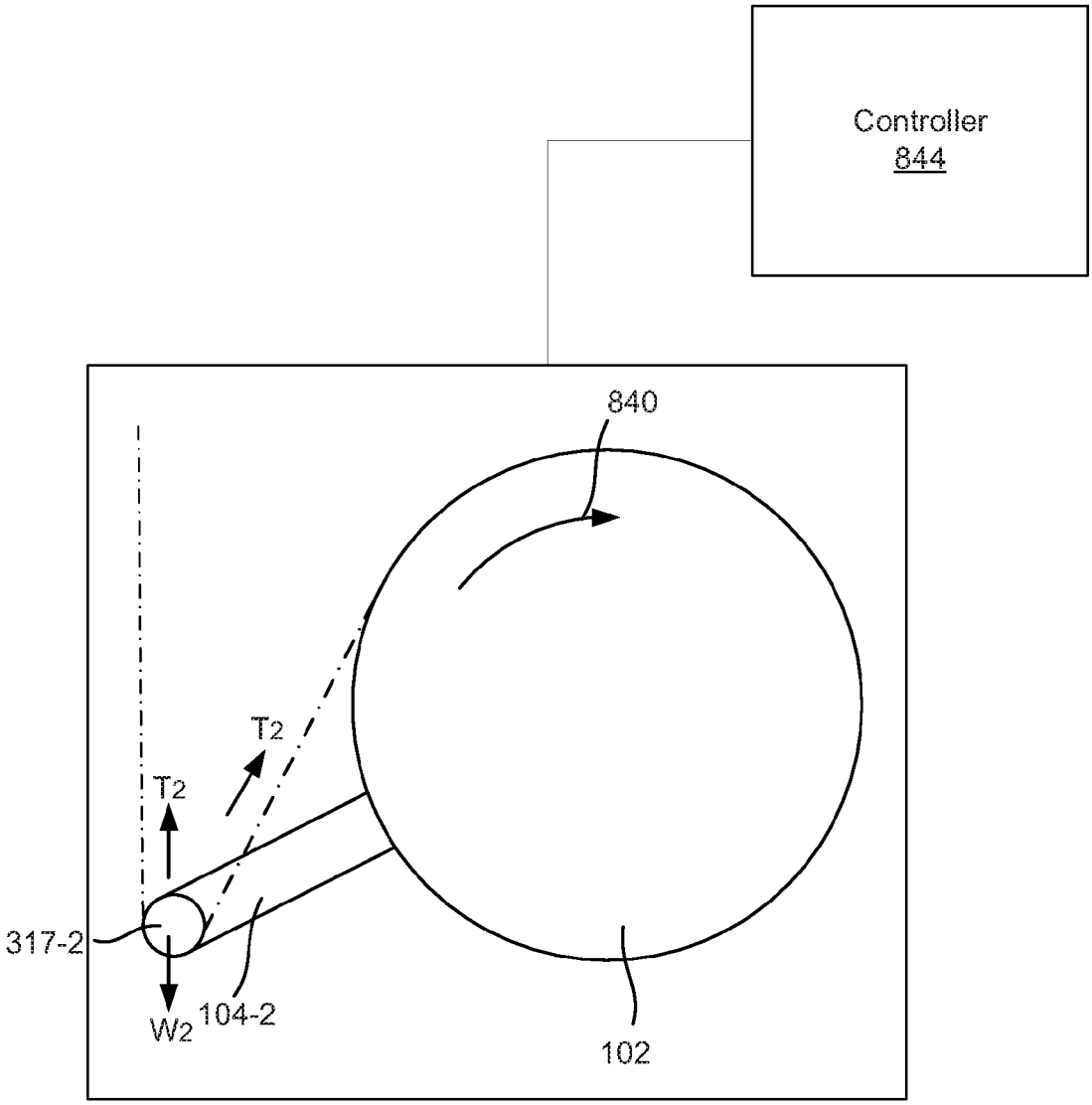
FIG. 11 is a cross-sectional side view of the movable arm in a lower tension setting, according to an example of the principles described herein.

FIG. 11 is a cross-sectional side view of the movable arm (104) in a lower tension setting, according to an example of the principles described herein. Specifically, FIG. 11 depicts applying a fourth tension, which is less than the first tension and the second tension. This may be done by altering the position of the movable arm (104) relative to the winding direction. For example, to impart a first tension, the media is wound in the clockwise direction (842), and the movable arm (104) is in a raised position as indicated by the reference number (FIG. 8, 104-1) as depicted in FIG. 8. To effectuate the fourth tension, the movable arm (104) and shaft (317) may be lowered to the lower position as indicated by the reference numbers (104-2) and (317-2), while continuing to wind the media in the clockwise direction (840). Doing so decreases the tension on the media on account of the angle of the movable arm (104). More specifically, the second tension and the first tension are represented by the equation T=W. When the arm is in the lowered position as indicated by the reference number (104-2) and media is wound in the clockwise direction (840), the tension can be represented by T=W/2, which is less than the first and second tensions represented as T=W.

Figure 12:
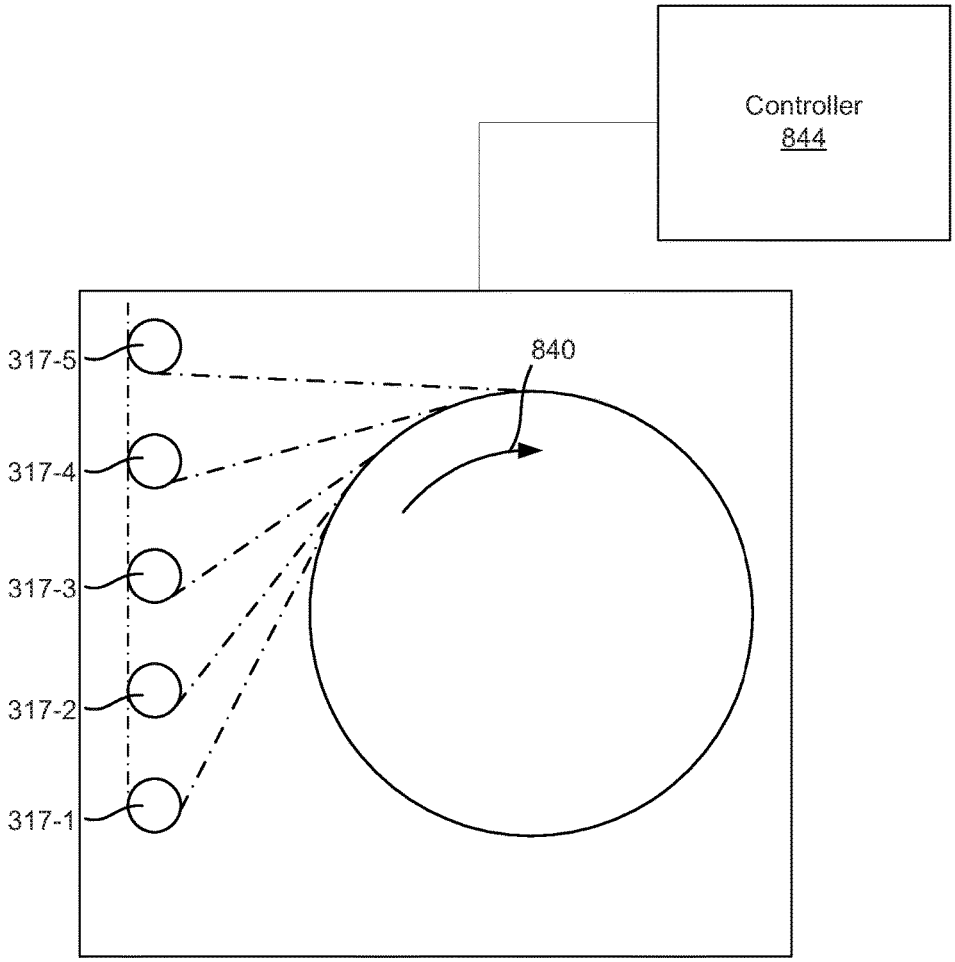
FIG. 12 is a cross-sectional side view of the movable arm in multiple intermediate positions, according to an example of the principles described herein.

FIG. 12 is a cross-sectional side view of the movable arm (FIG. 1, 104), and specifically the shaft (317) in multiple intermediate positions, according to an example of the principles described herein. For simplicity in FIG. 12, the arm component of the movable arm (FIG. 1, 104) has been omitted and reference is made to the shaft (317) portion of the movable arm (FIG. 1, 104).

As described above, instead of the radially positioned optical sensors, in some example, the sensor may include an encoder wheel that includes a finer granularity of sensor readings, accordingly leading to a finer granularity regarding angular position of the movable arm (FIG. 1, 104). With a finer granularity in determining the position of the movable arm (FIG. 1, 104), finer granularity regarding the tension of the media may also be achievable. That is the movable arm (FIG. 1, 104) may change between a number of intermediate positions between the first position and the second position, thereby effectuating different tensions on the media. While, FIG. 12 depicts the five various positions represented by the suffixes, −1, −2, −3, −4, and −5, relative to winding in the clockwise direction (840), the multiple intermediate positions may also correspond to the counterclockwise direction (842) thus affording even more discretized tension settings. The increased number of intermediate positions also allows for a more accurate maintenance of desired tension due to changes in the diameter of the media reel as more media is acquired on the reel.

Figure 13:
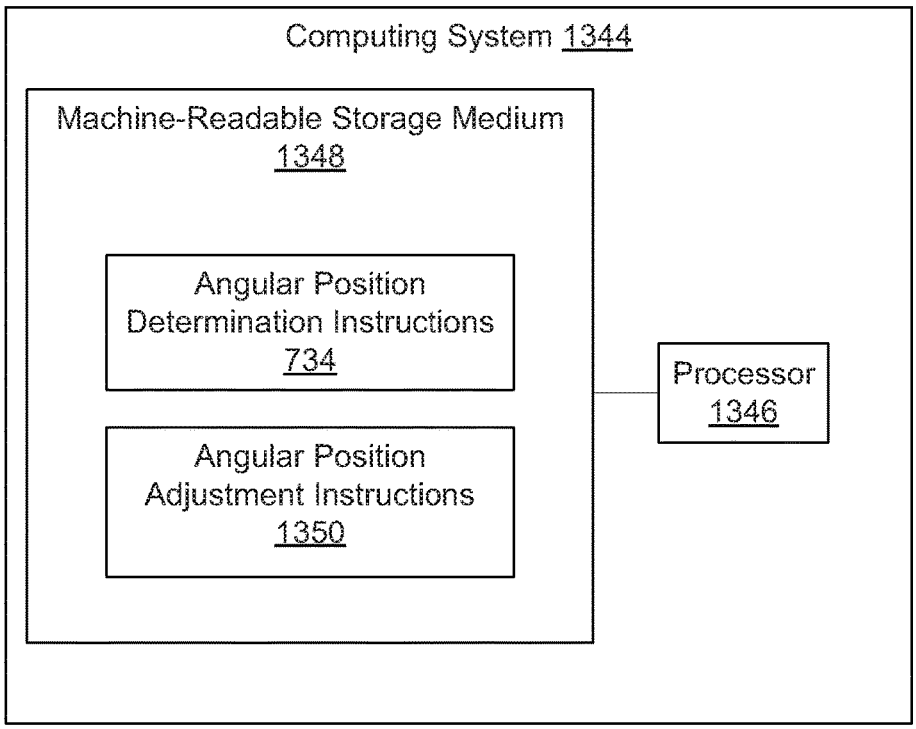
FIG. 13 is a block diagram of a system for adjusting tension on media being wound around a reel, according to an example of the principles described herein.

FIG. 13 is a block diagram of a system (1344) for adjusting tension on media being wound around a reel (FIG.

1, 102), according to an example of the principles described herein. One or more of the components of the system, i.e., the processor (1346), machine-readable storage medium (1348), and instructions (1350, 1352) may or may not be combined with corresponding components of the system (1344) described earlier.

To achieve its desired functionality, the computing system (1344) includes various hardware components. Specifically, the computing system (1344) includes a processor (1346) and a machine-readable storage medium (1348). The machine-readable storage medium (1348) is communicatively coupled to the processor (1346). The machine-readable storage medium (1348) includes a number of instruction sets (734, 1350) for performing a designated function. The machine-readable storage medium (1348) causes the processor (1346) to execute the designated function of the instruction sets (734, 1350).

Although the following descriptions refer to a single processor (1346) and a single machine-readable storage medium (1348), the descriptions may also apply to a computing system (1344) with multiple processors and multiple machine-readable storage mediums. In such examples, the instruction sets (734, 1350) may be distributed (e.g., stored) across multiple machine-readable storage mediums and the instructions may be distributed (e.g., executed by) across multiple processors.

The processor (1346) may include at least one processor and other resources used to process programmed instructions. For example, the processor (1346) may be a number of central processing units (CPUs), microprocessors, and/or other hardware devices suitable for retrieval and execution of instructions stored in machine-readable storage medium (1348). In the computing system (1344) depicted in FIG. 13, the processor (1346) may fetch, decode, and execute instructions (734, 1350) for detecting media presence. In one example, the processor (1346) may include a number of electronic circuits comprising a number of electronic components for performing the functionality of a number of the instructions in the machine-readable storage medium (1348). With respect to the executable instruction representations (e.g., boxes) described and shown herein, it should be understood that part or all of the executable instructions and/or electronic circuits included within one box may, in alternate examples, be included in a different box shown in the figures or in a different box not shown.

The machine-readable storage medium (1348) represent generally any memory capable of storing data such as programmed instructions or data structures used by the computing system (1344). The machine-readable storage medium (1348) includes a machine-readable storage medium that contains machine-readable program code to cause tasks to be executed by the processor (1346). The machine-readable storage medium (1348) may be tangible and/or non-transitory storage medium. The machine-readable storage medium (1348) may be any appropriate storage medium that is not a transmission storage medium. For example, the machine-readable storage medium (1348) may be any electronic, magnetic, optical, or other physical storage device that stores executable instructions. Thus, machine-readable storage medium (1348) may be, for example, Random Access Memory (RAM), a storage drive, an optical disc, and the like. The machine-readable storage medium (1348) may be disposed within the computing system (1344), as shown in FIG. 13. In this situation, the executable instructions may be "installed" on the computing system (1344). In one example, the machine-readable storage medium (1348) may be a portable, external or remote storage medium, for example, that allows the computing system (1344) to download the instructions from the portable/external/remote storage medium. In this situation, the executable instructions may be part of an "installation package". As described herein, the machine-readable storage medium (1348) may be encoded with executable instructions for dual-power reception.

Referring to FIG. 13, angular position instructions (734), when executed by a processor (1346), may cause the computing system (1344) to determine an angular position of the movable arm (FIG. 1, 104) that is coupled to the reel (FIG. 1, 102). Angular position adjustment instructions (1350), when executed by a processor (1346), may cause the computing system (1344) to adjust the angular position of the movable arm (FIG. 1, 104) so as to wind the media with a desired tension. In some examples, the processor (1346) and machine-readable storage medium (1348) are located within the same physical component, such as a server, or a network component. The machine-readable storage medium (1348) may be part of the physical component's main memory, caches, registers, non-volatile memory, or elsewhere in the physical component's memory hierarchy. In one example, the machine-readable storage medium (1348) may be in communication with the processor (1346) over a network. Thus, the computing system (1344) may be implemented on a user device, on a server, on a collection of servers, or combinations thereof.

The computing system (1344) of FIG. 13 may be part of a general-purpose computer. However, in some examples, the computing system (726) is part of an application specific integrated circuit.

In one example, a media detection device and system 1) enhances printing device performance; 2) tailors printing device functionality based on the presence of media; 3) is cheap and cost-effective to implement; 4) can impart a single tension to media regardless of a wind direction; and 5) can impart different various tensions to the media to accommodate different printing scenarios. However, it is contemplated that the devices disclosed herein may provide useful in addressing other matters and deficiencies in a number of technical areas. Therefore, the systems and methods disclosed herein should not be construed as addressing any of the particular matters.

The preceding description has been presented to illustrate and describe examples of the principles described. This description is not intended to be exhaustive or to limit these principles to any precise form disclosed. Many modifications and variations are possible in light of the above teaching.

What is claimed is:

1. A device to collect media comprising:

a reel that collects the media;

a movable arm pivotally coupled to the reel to provide tension to the media being wound around the reel;

a controller to detect when media is being wound around the reel by:

determining an angular position of the movable arm; and calculating, based on the angular position of the movable arm, when an output of a motor that rotates the reel is non-zero; and a sensor to provide the controller with information regarding the angular position of the movable arm, wherein:

the sensor comprises a series of radially positioned optical sensors disposed about a pivot point; and an optical sensor is to detect the angular position of the movable arm as a flange of the movable arm interrupts an optical path between an emitter and a detector of the optical sensor.

2. The device of claim 1, further comprising a printing component to deposit a printing fluid on the media.

3. The device of claim 1, further comprising a laminating component to apply a protective cover to the media.

4. The device of claim 1, wherein the movable arm is movable between two positions for each of a forward direction and a reverse direction.

5. A method of operating the device of claim 1, the method comprising, with the controller:

determining the angular position of the movable arm that is coupled to the reel by receiving from a sensor, information regarding the angular position of the movable arm, wherein:

the sensor comprises a series of radially positioned optical sensors disposed about a pivot point; and an optical sensor is to detect the angular position of the movable arm as a flange of the movable arm interrupts an optical path between an emitter and a detector of the optical sensor;

calculating, based on the angular position of the movable arm, an output of the motor that rotates the reel; and indicating that media is actively being wound around the reel when the output of the motor that rotates the reel is non-zero.

6. The method of claim 5, further comprising controlling operation of at least one component of a media processing system when media is actively being wound around the reel.

7. The method of claim 6, wherein the at least one component is selected from the group consisting of a media cutting system and a media transporting system.

8. The method of claim 6, wherein controlling operation of at least one component of the media processing system comprises sending a control signal to a controller of the at least one component.

9. The method of claim 6, wherein controlling operation of the at least one component of the media processing system comprises temporarily suspending operation of the at least one component.

10. The method of claim 5, further comprising maintaining a predetermined tension on the media being wound onto the reel via the movable arm.

11. The device of claim 1, wherein:

the movable arm changes angular position to provide different tensions to the media; and the controller is to adjust the angular position of the movable arm to effectuate a desired tension on the media.

12. The device of claim 11, wherein the controller adjusts the angular position of the movable arm by adjusting the winding speed of the reel.

13. The device of claim 11, wherein:

the reel winds the media in a direction, wherein the direction is selected from the group consisting of a clockwise direction and a counterclockwise direction;

when media is wound in the clockwise direction, the movable arm is in a first position to impart a first tension on the media;

when media is wound in the counterclockwise direction, the movable arm is in a second position to impart a second tension on the media; and the first tension is the same as the second tension.

14. The device of claim 13, wherein the first position is a raised position and the second position is a lowered position.

15. The device of claim 14, wherein the movable arm has a number of intermediate positions between the first position and the second position.

16. The device of claim 14, further comprising a sensor to provide the controller with information regarding the angular position of the movable arm.

17. The device of claim 11, wherein the controller adjusts the angular position of the movable arm based on information selected from the group consisting of an identified media type and a diameter of the media on the reel.

* * * * *